US005368196A

United States Patent [19]

Hellenberg et al.

[11] Patent Number: 5,368,196

[45] Date of Patent: Nov. 29, 1994

[54] APPARATUS FOR METERING AND DISPENSING FLOWABLE MATERIALS TO FORM A BLENDED COMPOSITION

[75] Inventors: Leendert Hellenberg, Warmond; Johannes H. Mink, Voorhout, both of Netherlands

[73] Assignee: Fluid Management Limited Partnership, Wheeling, Ill.

[21] Appl. No.: 36,415

[22] Filed: Mar. 25, 1993

[51] Int. Cl.[5] ..... B67D 5/08

[52] U.S. Cl. ..... 222/61; 222/135; 222/145

[58] Field of Search ..... 222/61, 394, 396, 397, 222/135, 630, 145

[56] References Cited

U.S. PATENT DOCUMENTS

| | | | |
|---|---|---|---|
| 2,654,505 | 10/1953 | Fuhrman | 222/2 |
| 2,787,402 | 4/1957 | Stiner et al. | 222/76 |
| 2,848,019 | 8/1958 | Corbin et al. | 141/100 |
| 3,349,962 | 10/1967 | Levin | 222/2 |
| 4,046,287 | 9/1977 | Hoekstra et al. | 222/16 |
| 4,675,301 | 6/1987 | Charneski et al. | 222/396 |
| 4,935,261 | 6/1990 | Srivastava et al. | 222/61 |
| 4,946,200 | 9/1990 | Flemming et al. | 239/1 |
| 5,119,973 | 6/1992 | Miller et al. | 222/135 |
| 5,277,333 | 1/1994 | Shimano | 222/61 |

FOREIGN PATENT DOCUMENTS

| | | | |
|---|---|---|---|
| 0283137B1 | 4/1992 | European Pat. Off. | B05B 1/32 |

OTHER PUBLICATIONS

"The Colour Philosophy," 16 page Trade Brochure of (manufacturer) COROB (no date available).

"*Miller* Accutinter® 4000 Colorant Dispenser," 1 page, 2-sided Brochure RA9114/ACC4000, Printed in USA, Miller Manufacturing® A Division of *Fluid Management* Limited Partnership, Addison, Ill. (no date shown on brochure).

"*Miller* Accutinter® 400 Colorant Dispenser," 1 page, 2-sided Brochure RA9019/ACC400, Printed in USA, Miller Manufacturing® A Division of *Fluid Management* Limited Partnership, Addison, Ill. (no date shown on brochure).

"*Miller* Accutinter® 600 Fluid dispenser," 1 page, 2-sided Brochure RA90108/ACC600, Printed in USA, Miller Manufacturing® A Division of *Fluid Management* Limited Partnership, Addison, Ill. (no date shown on brochure).

"The Eurotinter: A Powerful and Well Researched Concept.," 1 page brochure, Ateliers Sussmeyer S. A., Bruxelles (no date shown on brochure).

"Eurotinter E-12-AS and E-16-AS -An Avalance of Possibilities.," 1 page brochure, Ateliers Sussmeyer S.A., Bruxelles (no date shown on brochure).

"E. T. Junior: Low Investment for Tinting Paints and Varnishes for Retail Distribution," 1 page brochure, Ateliers Sussmeyer S.A., Bruxelles (no date shown on brochure).

"From Retail Shop to In-Plant Production Unit-The Eurotinter," 1 page brochure, Ateliers Sussmeyer S.A., Bruxelles (no date shown on brochure).

*Primary Examiner*—Andres Kashnikow
*Assistant Examiner*—Philippe Derakshani
*Attorney, Agent, or Firm*—Fitch, Even, Tabin & Flannery

[57] ABSTRACT

A dispenser for liquid and pulverulent materials provides a cabinet with a pressurized chamber for electrical control equipment. Materials to be dispensed are controlled by a pilot valve and a dispense valve, for each different material to be dispensed. A dispense head is cantilevered from the cabinet, so as to overhang a container receiving the dispensed materials.

13 Claims, 5 Drawing Sheets

APPARATUS FOR METERING AND DISPENSING FLOWABLE MATERIALS TO FORM A BLENDED COMPOSITION

BACKGROUND OF THE INVENTION

1. Field of the Invention

The present invention pertains to apparatus for dispensing liquid and pulverulent materials.

2. Description of the Related Art

The assignee of the present invention has provided a number of commercially successful automatic dispensing machines. These machines have found ready acceptance in the paint and coatings art. Examples of these machines are shown in U.S. Pat. Nos. 4,813,785; 4,967,938; 5,078,302; and 3,851,798.

The machines referred to above are especially adapted for dispensing materials into containers which can be carried by hand, or which can also be delivered by conveyors to points remote from the dispensing station. For very high volume production runs, or when unusually large containers are to be filled, an unusually large source of material to be dispensed must be kept on hand at the dispensing station, and must be readily replenished, if necessary, during a work shift to keep the dispensing station fully operational with a maximum utilization. One example of such a situation is found in paint production facilities or where basic ingredients of a paint formulation are manufactured or otherwise produced. It has been found advantageous to provide what may be called "continuous" material supply, theoretically a supply of infinite size compared to the amount of material required during prolonged production runs. A typical situation may be visualized as a "tank farm" of containers coupled together through manifold arrangements to produce a source for a pipeline which runs through the production plant, with the pipeline being coupled to a dispensing apparatus. Special arrangements must be made to accommodate these so-called "infinite sources" of material and improvements in dispensing machinery for such installations have been sought.

SUMMARY OF THE INVENTION

It is an object of the present invention to provide dispensing apparatus for large sources of materials to be dispensed.

Another object according to principles of the present invention is to provide dispensing apparatus with externally-located material storage facilities which are coupled to dispensing apparatus on board the machine.

A further object according to principles of the present invention is to provide improved high volume dispensing apparatus which provides and which reduces the risks associated with dispensing materials which may be explosive or which may lead to explosive conditions under certain circumstances.

These and another objects according to principles of the present invention are provided in apparatus for dispensing material into a container, comprising:

a housing defining an interior volume;

a dispense head in said housing for directing a flow of material therethrough in response to control commands;

a plurality of pilot valves;

pneumatic coupling means for coupling a pneumatic pressure source to said pilot valves;

electrical control means coupled to the pilot valves so as to operate the pilot valves in response to user-determined control commands;

a plurality of dispensing valves, each having inputs for receiving a flow of material, and a metering output for delivering a controlled amount of material to said dispense head and each dispensing valve having a pneumatic command input;

inter-valve conduit means coupling said pilot valves to the pneumatic command inputs of respective ones of said dispensing valves;

inlet conduit means coupling the inputs of said dispensing valves to an external supply source of material; and metering output conduit means coupling the metering outputs of said dispensing valves to said dispense head.

DETAILED DESCRIPTION OF THE PREFERRED EMBODIMENTS

Figure 1:
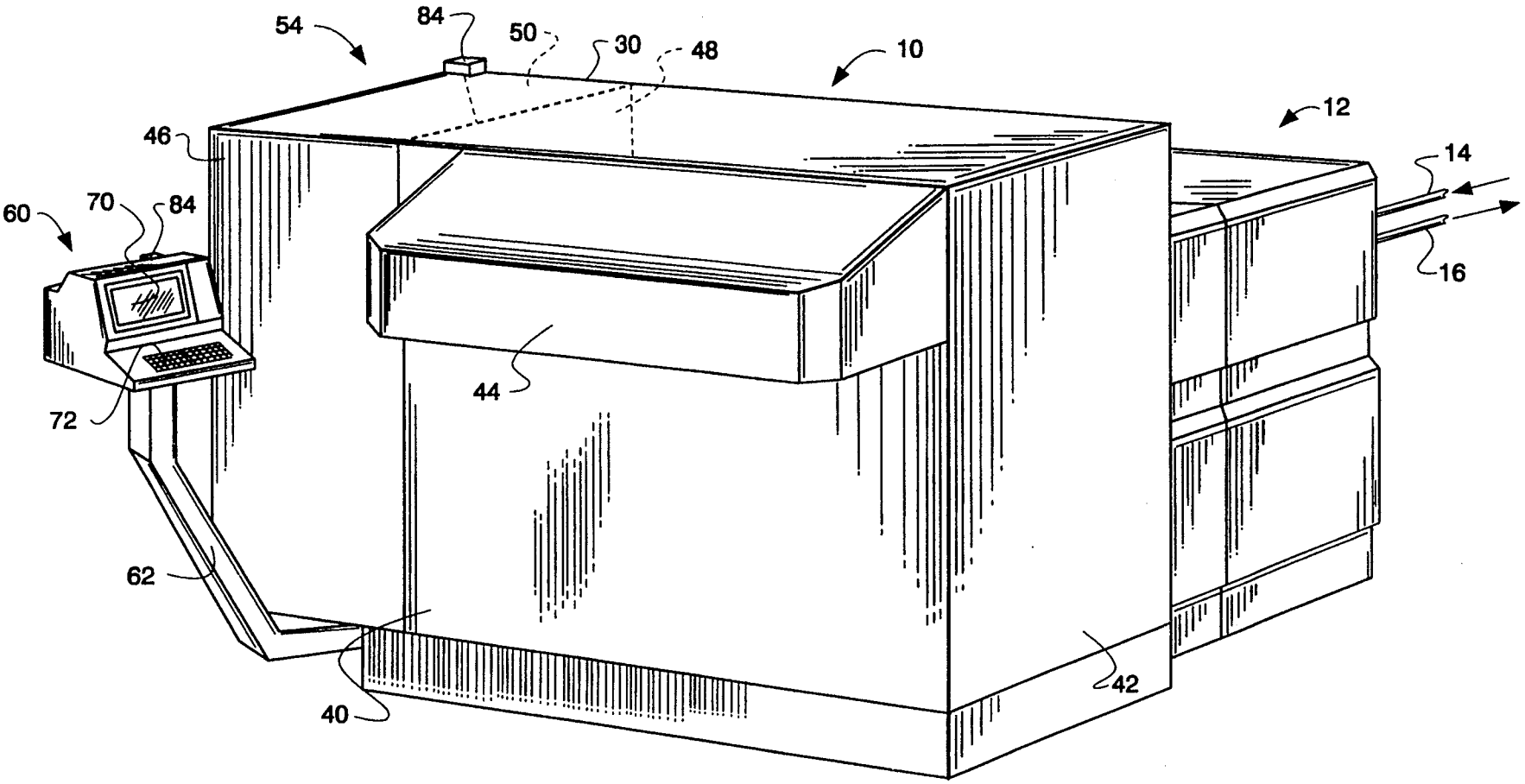
FIG. 1 is a perspective view of dispensing apparatus according to principles of the present invention.

Turning now to the drawings, FIG. 1 shows dispensing apparatus according to principles of the present invention, generally indicated at 10. According to one aspect of the present invention, the dispensing apparatus does not include on-board storage of materials to be dispensed, but rather is concerned solely with handling a pressurized source of materials provided from an external source. One example of an external source is the pumping modules generally indicated at 12. Inlet and outlet conduits provide a flow path of material to be dispensed from a storage site (not shown).

The pumping module induces a flow of material into conduit 14 and returns the material flow back to the storage site through an outlet conduit or return conduit 16. The pumping module 12 includes motor-driven pumps which pressurize the material, creating or augmenting the flow through conduits 14, 16, directing the material flow through dispensing apparatus 10. For example, with reference to FIG. 3, the pump outlet from module 12 produces material flow in conduit an intervalve 20, which passes through a dispensing valve 22, exiting the valve through return conduit 16 which passes through dispensing apparatus 10 and pumping module 12, as indicated in FIG. 1, to return to the storage site. As contemplated herein, the storage site may comprise canisters or other containers of varying size, may comprise a "tank farm", or may even comprise an on-site internal piping system as may be encountered in a very large material production facility. Further details concerning the pump module 12 are given in U.S. patent application Ser. No. 08/036,671, filed Mar. 25, 1994, the subject matter of which is incorporated herein as if fully set forth herein.

Figure 2:
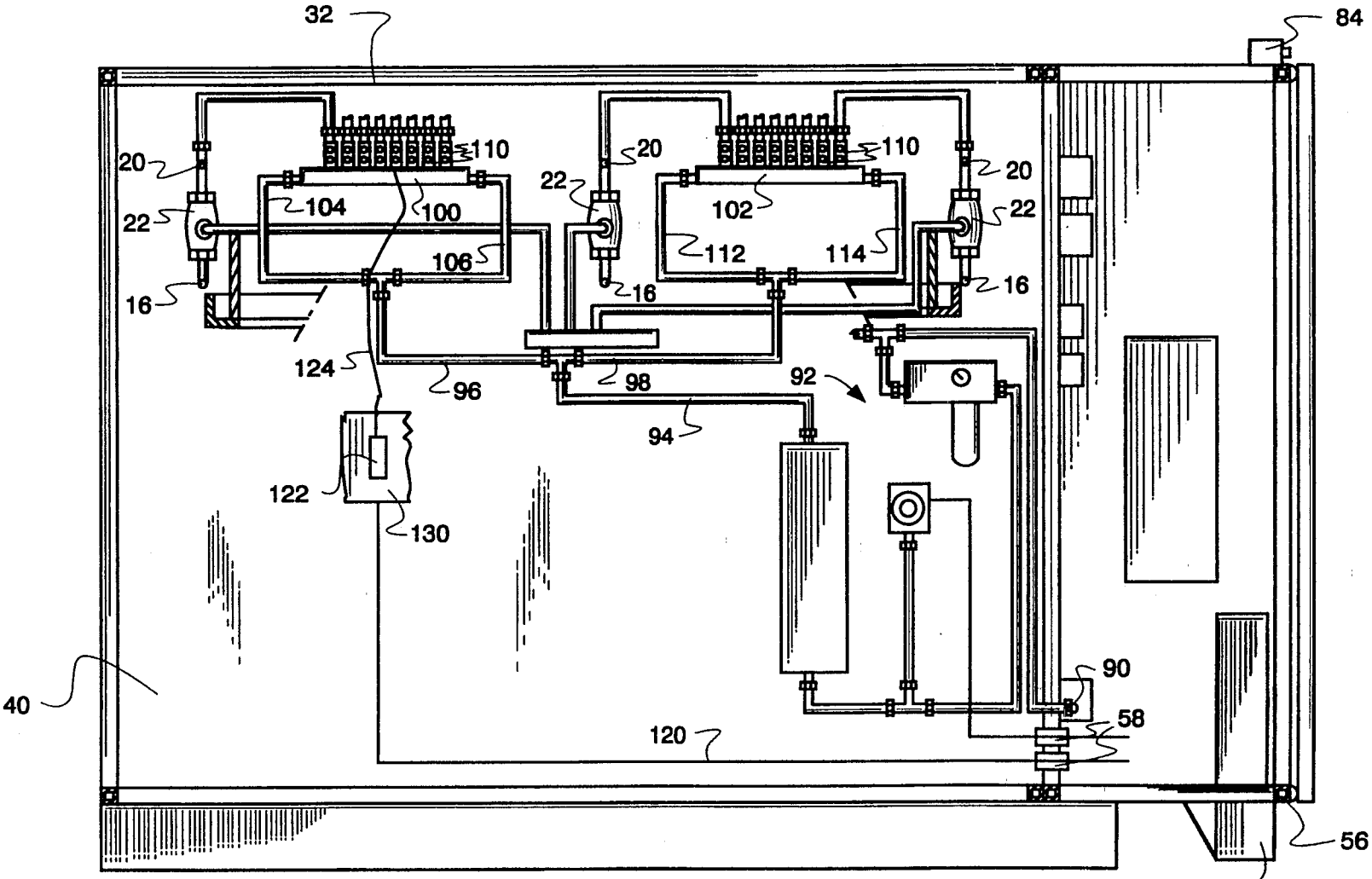
FIG. 2 is a rear elevational view thereof.
Figure 3:
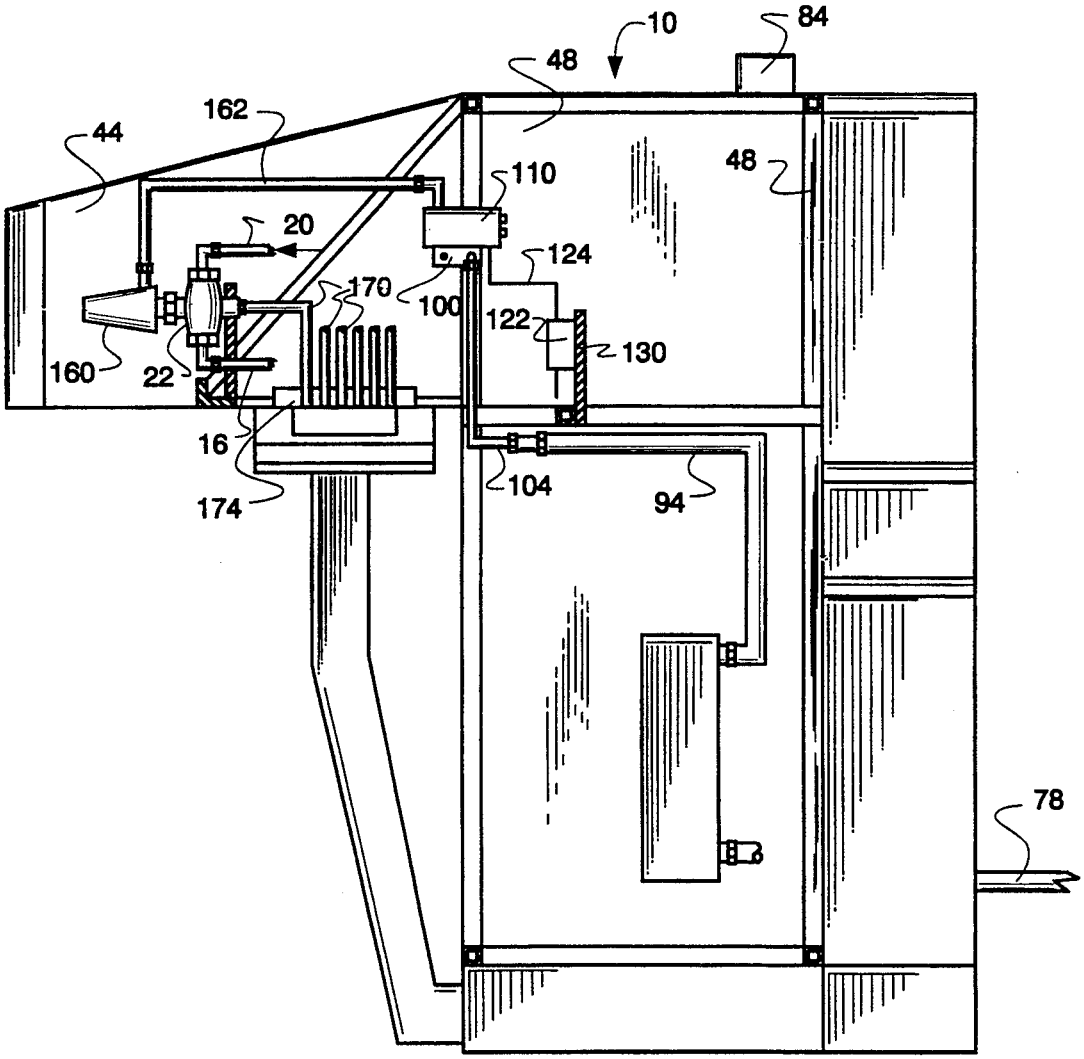
FIG. 3 is a side elevational view taken from the right side thereof.
Figure 4:
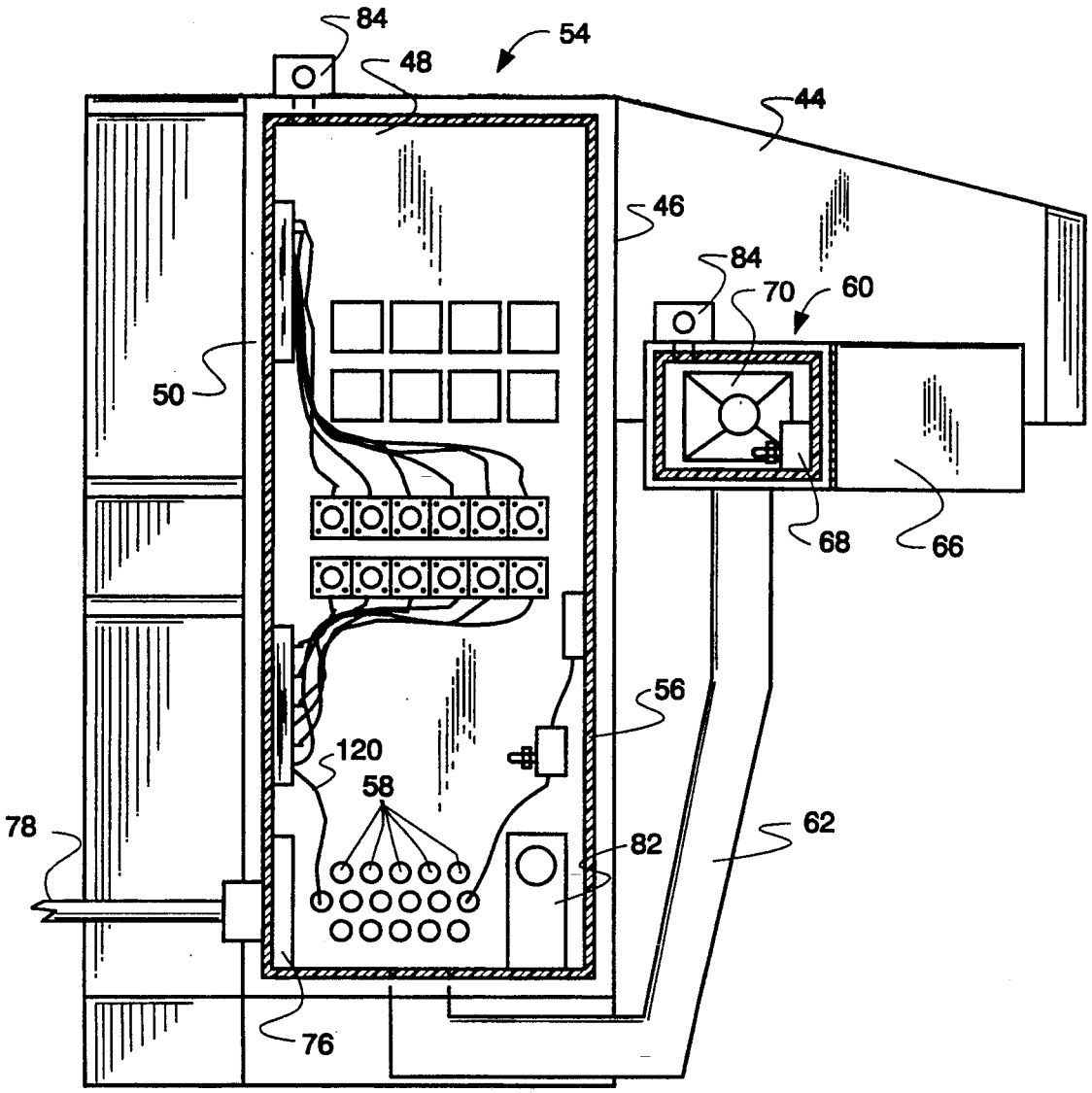
FIG. 4 is a side elevational view taken from the left side thereof.

Dispensing apparatus 10 includes a cabinet 30, comprising sheet metal panels removably mounted on a framework 32 (shown for example in FIGS. 2 and 3). The framework 32 is preferably constructed of hollow tubing. The cabinet includes a front sheet metal panel 40, a side sheet metal panel 42, a sheet metal hood 44, all of which are removable to allow access to the internal components. The sheet metal panel 46 and internal walls 48, 50 cooperate to form a cabinet enclosure generally indicated at 54. Referring to FIG. 4, an access door (see FIG. 2) has been removed to show the interior of cabinet 54, which houses electrical control equipment which controls the dispensing of material, and optionally of external apparatus such as the pumping module 12. As shown in FIG. 4, the opening of cabinet 54 has a gasket seal 56 to provide an air-tight enclosure when the access door is closed. According to one aspect of the present invention, the cabinet 54 is pressure-tight, suitable for maintaining an elevated pressure therein so as to prevent the ingress of materials being dispensed into the chamber interior, thereby providing a "safe zone" for the electronic and electrical equipment disposed within the chamber. A plurality of pressure sealing glands 58 are inserted in wall 48, to provide a pressure-tight seal for conductors, pipes and conduits, and other items passing through wall 48, which provide communication with the control circuitry components within cabinet 54.

Referring again to FIGS. 1 and 4, an equipment cabinet 60 is mounted on a pedestal 62 receiving cantilever support from cabinet 30. According to one aspect of the present invention, the cabinet 60 is pressure-tight, capable of sustaining an over pressure, i.e., a pressure elevated above ambient. The pedestal 62 preferably comprises a hollow conduit for air flow entering cabinet 60 from cabinet 54. Cabinet 60 includes a hinged access door 66 and a pressure-tight gasket 68 surrounding the opening at the rear of the cabinet. A CRT monitor 70 and a keyboard 72 are mounted in cabinet 60 and provide input/output communication with a digital microcomputer control unit 76. Electrical connections between cabinets 54, 60 are located in the sealed pedestal 62 which functions as a protected cable raceway connecting the control components in the cabinets 54, 60.

Referring again to FIG. 4, a conduit 78 is connected to an external source of pressurized air or suitable relatively inert gas. Air flow through conduit 78 enters cabinet 54, pressurizing the cabinet under the control of an environmental control unit 82, preferably the Model No. SE-001 EExp control unit available from Didex Corporation. Auxiliary control units 84, Model SE-003, also available from Didex, are mounted on the cabinets 54, 60. Under control of unit 82, the auxiliary units 84 release air which has been allowed to fill the cabinets 54, 60, thus purging the cabinets prior to startup of the electrical components disposed therein. Control unit 82 is programmed for a number of successive air changes within the cabinets, and thereafter maintains a preset level of overpressure within the cabinets, with a continuous air flow passing through the cabinets, and exiting the auxiliary units 84. Functionally, the cabinets 54, 60 and the interconnecting pedestal 62 cooperate to comprise a single "safe zone" for electrical control circuitry.

Referring now to FIG. 2, pressurized air entering conduit 78 is directed to connected means or conduit 90 within cabinet 54, passing through pneumatic control equipment (such as user settable pressure monitoring means for monitoring and maintaining pressure at a desired level) generally indicated at 92, entering conduit 94, which, as will be seen, is used for valve actuation. The air flow is divided into conduits 96, 98 so as to be directed to manifolds 100, 102. Air flow through conduit 96 is again divided into separate flows through conduits 104, 106 so that air pressure enters both sides of manifold 100 to more rapidly pressurize the pilot valves 110 associated therewith. Similarly, air flow enters a second, substantially identical manifold 102 through conduits 112, 114. Referring to FIGS. 2 and 4, an electrical conductor 120 is coupled to control equipment within cabinet 54, passing through one of the pressure-sealing glands 58 to enter the main compartment of the dispensing apparatus. Conductor 120 is connected to a control unit 122, which in turn is coupled through conductor 124 to a pilot valve 110, opening and closing the pilot valve 110 in response to appropriate command signals from control circuitry disposed within cabinet 54. Control unit 122 is mounted on a backing plate 130. Although only a single connection is shown in FIG. 2, for purposes of drawing clarity, it should be understood that each pilot valve 110 has its own respective connection to control circuitry located within cabinet 54, such that each individual pilot valve can be selectively operated, as desired.

Figure 5:
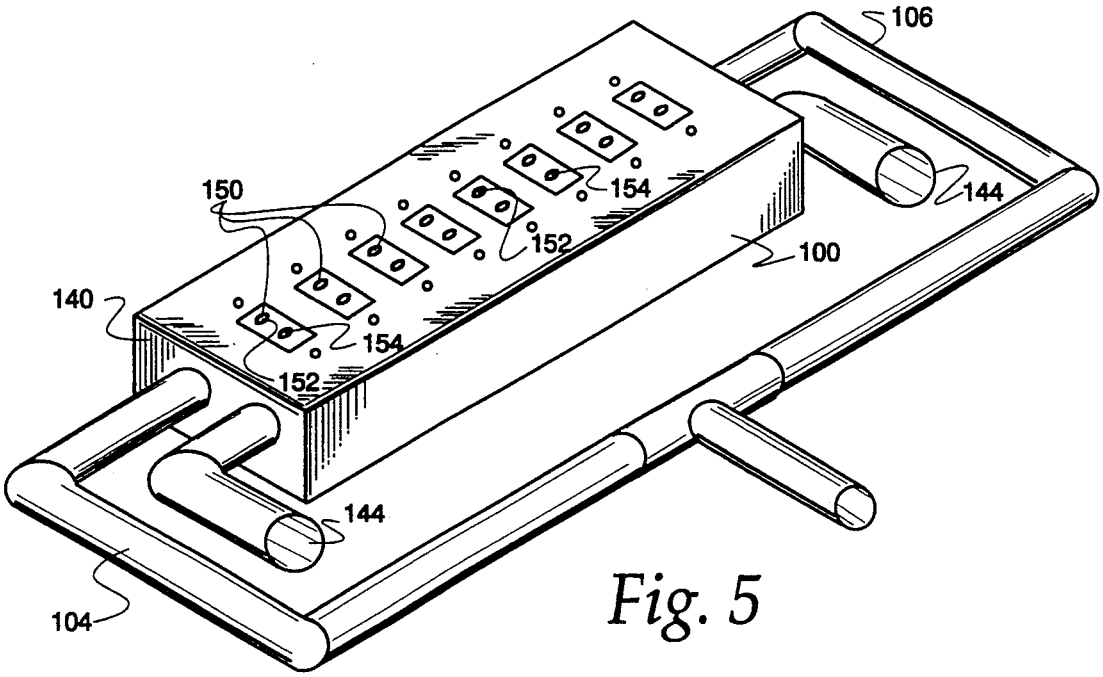
FIG. 5 is a perspective view of a valve manifold.

Referring to FIG. 5, manifold 100 is preferably formed from a monolithic metal block, of preferably a stainless steel material, to form two continuous passageways extending through manifold 100, along its major axis. A first passageway extends between the opposed end faces 140 of the manifold and a completed circuit through the manifold is formed by conduits 104, 106. A second, substantially continuous passageway is formed in manifold 100 and extends generally parallel thereto. The second passageway also extends between the opposed end faces 140 and is connected to end fittings 144. As can be seen at the top of manifold 100, a series of valve-mounting ports 150 are provided, each port for a respective pilot valve 110. The ports 150 include openings 152, 154 communicating with the respective passageways through manifold 100. For example, the apertures 152 communicate with the pressurized air flow entering manifold 100 through conduits 104, 106. The apertures 154 are provided to relieve air pressure within pilot valve 110 and the pneumatic equipment connected to pilot valve 110.

Turning now to FIGS. 2 and 3, each pilot valve 110 is connected to a respective dispensing valve 22 through a pneumatic piston operator 160. In the preferred embodiment, a conduit 162 is connected between pilot valve 110 and pneumatic operator 160, and provide air pressure when command signals through electrical conductor 124 open pilot valve 110. In the preferred embodiment, this causes operator 160 to function so as to open dispense valve 22, temporarily diverting material flow through the valve to a metering outlet 170. The metering outlet 170 of respective dispense valves 22 are terminated in a common dispense head 174.

Figure 6:
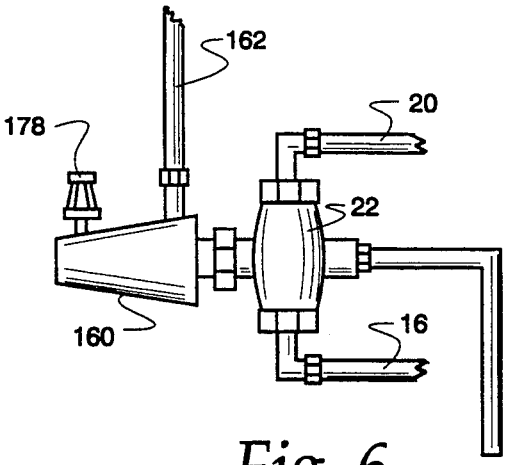
FIG. 6 is a side elevational view of an alternative dispensing valve arrangement.
Figure 7:
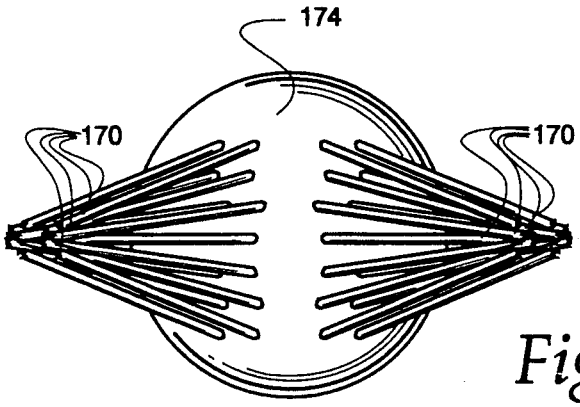
FIG. 7 is a top plan view of the dispensing head of FIGS. 2 and 3.

When a desired amount of material is diverted to dispense head 174, control signals in conductor 124 cause pilot valve 110 to close, terminating the pressurized air signal in line 162. A return spring within operator 160 overcomes the decaying air pressure signal, forcing dispensing valve 22 to close, effectively terminating the dispense operation. As will be appreciated by those skilled in the art, the return spring within operator 160 must overcome air pressure stored within the operator, entering through line 162. Air within operator 160 is forced back through pressure venting means including a line 162 leading to pilot valve 110, and to directional valving within the pilot valve, so as to exit manifold 100 through fittings 144. Referring now to FIG. 6, in order to provide faster valve closing, and to reduce back pressure during exhausting of the dispense valve, a second pressure venting means, or exhaust outline member 178 is mounted to pneumatic operator 160, with exhaust being vented directly to the atmosphere surrounding the dispense valve.

As can be seen in FIG. 3, for example, the pilot valves, dispense valves, and dispense head are located within the hood member 44, so as to overhang a container to be filled. This arrangement allows the dispense valves 22 to be located very close to the dispense head 174, thereby improving dispensing accuracy.

With the arrangement of the present invention, either pneumatic dispense valves or electrically operated dispense valves can be used. If electrically operated valves are to be used for the dispense valves, then electrical conductors 124 would be connected directly to the dispense valves, mounted in place of the pneumatic dispense valve 22. The dispense valves, if electrically operated, would have to be suitable for the intended purpose. For example, if hazardous materials are to be dispensed, then the electric valves should conform to local standards (i.e., must have an EEx-d rating, for example). It is generally preferred that more economical pneumatically operated dispense valves be used, with the pilot valves receiving electrical control signals, being located remote from the dispense head. With the present invention, the location of the pilot valves is not critical, and these may be located at even greater distances from the dispense valve, if desired.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for dispensing material into a container, comprising:

a housing defining an interior volume;

a dispense head in said housing for directing a flow of material therethrough in response to control commands;

a plurality of pilot valves;

pneumatic coupling means for coupling a pneumatic pressure source to said pilot valves;

electrical control means coupled to the pilot valves so as to operate the pilot valves in response to user-determined control commands;

a plurality of dispensing valves, each having an input for receiving a flow of material, and a metering output for delivering a controlled amount of material to said dispense head and each dispensing valve having a pneumatic command input;

inter-valve conduit means coupling said pilot valves to the pneumatic command inputs of respective ones of said dispensing valves;

inlet conduit means coupling the inputs of said dispensing valves to an external supply source of material; and metering output conduit means coupling the metering outputs of said dispensing valves to said dispense head.

2. The apparatus of claim 1 wherein pressure within said dispensing valves is relieved through the inter-valve conduit means.

3. The apparatus of claim 1 wherein pressure within said dispensing valves is relieved directly to the housing interior.

4. The apparatus of claim 1 wherein the dispensing valves further include outputs for directing a flow of material through the dispensing valves, and the apparatus further comprises outlet conduit means coupling the outputs of said dispensing valves to to an external supply source of material.

5. The apparatus of claim 1 wherein the housing further defines a pressurized compartment for enclosing the electrical control means.

6. The apparatus of claim 1 wherein the pilot valves are located between the pressurized compartment and the dispensing valves so as to remove the electrical control means from the immediate vicinity of the dispensing valves.

7. The apparatus of claim 1 wherein the apparatus further includes a hood cantilevered from said housing, with said dispense head and dispensing valves located within said hood so as to overhang a container being filled.

8. Apparatus for dispensing material into a container, comprising:

a first housing defining an interior volume;

a dispense head in said housing for directing a flow of material therethrough in response to control commands;

a plurality of dispensing valves, each having an input for receiving a flow of material, and a metering output for delivering a controlled amount of material to said dispense head;

connection means for connecting the first housing to an external supply source of pressurized gas;

pressure venting means for releasing pressure within the first housing;

user settable pressure monitoring means coupled to the connection means and to the pressure venting means for monitoring and maintaining pressure in the first housing at a preselected level.

9. The apparatus of claim 8 further comprising:

a second housing;

hollow conduit means coupling the first and second housings so as to pressurize the second housing; and the hollow conduit means supporting the second housing with a cantilever support from the first housing.

10. The apparatus of claim 9 wherein the second housing includes a second pressure venting means mounted to the second housing, for releasing pressure within the second housing.

11. The apparatus of claim 8 wherein the dispensing valves further include outputs for directing a flow of material through the dispensing valves, and the apparatus further comprises outlet conduit means coupling the outputs of said dispensing valves to to an external supply source of material.

12. The apparatus of claim 8 wherein the housing further defines a pressurized compartment for enclosing the electrical control means.

13. The apparatus of claim 8 wherein the user settable pressure monitoring means is also coupled to the second pressure venting means so as to maintain pressure in the second housing at a preselected level.

* * * * *